US009016438B2

(12) United States Patent
Altenburger

(10) Patent No.: US 9,016,438 B2
(45) Date of Patent: Apr. 28, 2015

(54) CARRYING DEVICE FOR RELOCATING A CAR OF AN ELEVATOR

(75) Inventor: Stefan Altenburger, Filderstadt (DE)

(73) Assignee: Thyssenkrupp Elevator AG, Essen (DE)

( * ) Notice: Subject to any disclaimer, the term of this patent is extended or adjusted under 35 U.S.C. 154(b) by 597 days.

(21) Appl. No.: 13/057,973

(22) PCT Filed: Aug. 24, 2009

(86) PCT No.: PCT/EP2009/006125

§ 371 (c)(1),
(2), (4) Date: Feb. 18, 2011

(87) PCT Pub. No.: WO2010/022907

PCT Pub. Date: Mar. 4, 2010

(65) Prior Publication Data

US 2011/0132693 A1 Jun. 9, 2011

(30) Foreign Application Priority Data

Sep. 1, 2008 (EP) ..... 08015375

(51) Int. Cl.
*B66B 9/16* (2006.01)
*B66B 9/00* (2006.01)

(52) U.S. Cl.
CPC .. *B66B 9/00* (2013.01); *B66B 9/003* (2013.01)

(58) Field of Classification Search
CPC ..... B66B 9/00; B66B 9/003
USPC ..... 187/249, 250
See application file for complete search history.

(56) References Cited

U.S. PATENT DOCUMENTS

| | | | | |
|---|---|---|---|---|
| 633,215 | A * | 9/1899 | Poulson | 198/798 |
| 1,859,483 | A * | 5/1932 | Winslow | 198/798 |
| 3,317,005 | A * | 5/1967 | Kehoe | 187/249 |
| 4,946,006 | A | 8/1990 | Kume | |
| 5,197,570 | A | 3/1993 | Matsui | |
| 5,235,144 | A | 8/1993 | Matsui et al. | |
| 5,799,755 | A | 9/1998 | Wan et al. | |
| 6,354,404 | B1 | 3/2002 | Sansevero et al. | |
| 2007/0181374 | A1 | 8/2007 | Mueller | |

(Continued)

FOREIGN PATENT DOCUMENTS

| | | | |
|---|---|---|---|
| DE | 2154923 | A1 * | 5/1973 |
| DE | 2203864 | A1 * | 8/1973 |
| DE | 2555310 | B1 * | 6/1977 |

(Continued)

OTHER PUBLICATIONS

EPO Communication, EP 08 015 375.2, Jul. 9, 2010.

*Primary Examiner* — William E Dondero
*Assistant Examiner* — Diem Tran
(74) *Attorney, Agent, or Firm* — Shlesinger, Arkwright & Garvey LLP

(57) ABSTRACT

A carrying device (1*b*) for relocating an elevator car (1*c*) of an elevator, which carrying device is movable in at least one direction (V) not corresponding to a longitudinal direction (B) of an elevator shaft in which the elevator car (1*c*) is moved in operation, wherein the elevator car (1*c*) is movable in the longitudinal direction (B) of the elevator shaft from an operating position into a receiving position in the carrying device (1*b*) and, in the receiving position, is connected to the carrying device (1*b*) and movable in the at least one direction (V) commonly with the carrying device (1*b*).

19 Claims, 2 Drawing Sheets

(56) References Cited

U.S. PATENT DOCUMENTS

| | | | | |
|---|---|---|---|---|
| 2011/0042168 | A1* | 2/2011 | Grundmann | 187/249 |
| 2014/0190774 | A1* | 7/2014 | Hsu et al. | 187/406 |

FOREIGN PATENT DOCUMENTS

| | | | |
|---|---|---|---|
| DE | 202 06 290 | U1 | 9/2002 |
| DE | 20 2004 009 022 | U1 | 10/2004 |
| EP | 0 471 464 | A2 | 2/1992 |
| EP | 0 509 647 | A1 | 10/1992 |
| EP | 2 070 860 | A1 | 6/2009 |
| JP | H04-317981 | A1 | 11/1992 |
| JP | H05-014071 | U | 2/1993 |
| JP | 2001-097648 | | 4/2001 |

* cited by examiner

CARRYING DEVICE FOR RELOCATING A CAR OF AN ELEVATOR

FIELD OF THE INVENTION

The invention relates to a carrying device for relocating a car of an elevator, in particular a carrying device for relocating an elevator car, which carrying device is movable in at least one direction not corresponding to a longitudinal direction of an elevator shaft of the elevator. Furthermore, the invention relates to a method for relocating the elevator car.

BACKGROUND OF THE INVENTION

In general, elevators have an elevator car which is movable in an elevator shaft. If the capacity of the elevator to be increased and thus the performance of the elevator to be enhanced, generally several elevator shafts are combined adjacent to each other in an elevator system. Apart from such a modular extension for increasing the capacity, there is an approach of operating several elevator cars in a single elevator shaft so as to further increase the performance of the elevator system. In order to avoid a mutual interference of the individual elevator cars within a commonly used elevator shaft, the elevator cars can be moved in a uniform direction in the respective elevator shaft in the same manner as in a paternoster, for example. However, in this case a respective separate shaft for the upwardly moving and the downwardly moving elevator cars has to be provided. Furthermore, there is a need of a device for transporting the individual elevator cars from the one elevator shaft or shaft to the other.

Other elevator systems use several shafts in which a number of elevator cars can be independently moved both upwards and downwards in the same respective shaft. At the upper and lower ends of the shafts, elevator cars are displaced from the one shaft to the adjacent shaft on demand so as to be able to provide the respective elevator car to the passengers according to demand and utilization.

If, for example, in a first shaft a first elevator car moves upwards within a particular section and a second elevator car is simultaneously demanded in this section for a downward movement, the second elevator car cannot be used in the first shaft in the opposite direction to the upward moving first elevator car. The second elevator car is thus transported, by means of a device for displacing elevator cars between the elevator shafts, between the first shaft to a second elevator shaft in which there are no elevator cars or at least only elevator cars which are not on a collision course in the respective section.

With such an exchange or displacement of the individual elevator cars to adjacent elevator shafts, the entire elevator system is very flexible and can flexibly and efficiently react to corresponding demands and thus increase the performance of the elevator system.

Another application range for devices for displacing elevator cars to other elevator shafts is illustrated in the patent document U.S. Pat. No. 5,799,755. Herein, an elevator car can be moved between two elevator shafts for providing an elevator system for large buildings or large lifting heights. In this case, an elevator car is translated on rollers in an elevator frame within a first shaft. At the end of the first shaft, the elevator car is rolled out of the frame and displaced to a rollable platform. The elevator car is then rolled from the rollable platform to another elevator frame which transports the elevator car further upwards in a second elevator shaft.

However, in the illustrated elevator system, several elevator cars cannot be operated within the same elevator shaft.

SUMMARY OF THE INVENTION

In contrast, the invention provides a carrying device for relocating a car of an elevator, which carrying device is movable in at least one direction not corresponding to a longitudinal direction of an elevator shaft in which the elevator car is moved in an operation. Herein, the elevator car is movable in the longitudinal direction of the elevator shaft from an operating position into a receiving position in the carrying device. Furthermore, in the receiving position, the elevator car is connected to the carrying device and movable in the at least one direction in common with the carrying device.

For example, the carrying device is configured such that it uses a free space between the elevator car and a shaft wall of the elevator shaft. In this manner, with the exception of small recesses for a use of the carrying device, no larger cross-sections of the elevator than in generally used elevator systems are required.

The above-mentioned operation is to be understood as a regular operation of the elevator during which the elevator car can be moved upwards and downwards in the elevator shaft and the moving direction of the elevator car is identical to the direction of extension or the longitudinal direction of the elevator shaft. The operating position describes a position of the elevator car within the elevator shaft which represents an initial position from which the elevator car is transferred into an accommodation in the carrying device. If the elevator car is connected to the carrying device and prepared to be transported or moved in common with the same, the elevator car is in the so-called receiving position and can be transported or translated in common with the carrying device. This is accompanied by an "outward transfer" of the elevator car from the actual elevator shaft and a reception or accommodation of the elevator car in the carrying device. The elevator car can subsequently be translated together with the carrying device and reintroduced into an elevator shaft (another elevator shaft, e.g. an adjacent elevator shaft).

The carrying device can be configured such that the elevator car is movable by means of a main drive of the carrying device from the operating position into the receiving position and/or from the receiving position into the operating position.

By means of the main drive of the carrying device, the carrying device can be moved in the at least one direction. The main drive of the carrying device, can be configured, for example, such that it enables a reception of the elevator car in the carrying device and a common movement as well as a subsequent release of the elevator car out of the carrying device. As the main drive, belt drives, spindle drives, rack drives, friction wheel drives or linear drives can be used. Furthermore, it is possible to configure the main drive such that several carrying devices can be driven in the same elevator shaft or the same track and moved independently. According to an exemplary embodiment, the main drive is arranged in a center of mass axis of the carrying device. This embodiment can be provided in particular for rectilinear movements of the carrying devices. Furthermore, it is possible to arrange two or more main drives in parallel. In this case, a resulting driving force acting upon the carrying device should again act upon its center of mass.

In case a rope system is used as the main drive, for example, suitable deflections of the ropes and suitable measures are required so as to provide a movement of the elevator car in the direction of the carrying device apart from the movement of the carrying device if the main drive is to be used for receiving the elevator car.

The carrying device can also comprise an auxiliary drive, wherein the elevator car is movable by means of the auxiliary drive from the operating position to the receiving position and/or from the receiving position to the operating position.

Such an auxiliary drive enables the movement of the elevator car into the receiving position or from the receiving position without using the main drive. The elevator car can be moved independently from the main drive in this case so that there is no need for an adaptation of the main drive for moving the elevator car. However, a combination of the auxiliary drive and the correspondingly configured main drive is of course also possible so that both drives cooperate in receiving the elevator car. As the auxiliary drive, drum drives or rope hoists attached to the carrying device, scissor drives or scissor lift grids, linear drives or other suitable auxiliary drives can be provided, for example.

Furthermore, the carrying device can comprise guide rail elements which lead the elevator car at least in sections during a movement from the operating position into the receiving position and/or from the receiving position into the operating position.

The guide rail elements can be provided for guiding the elevator car into the carrying device and for preventing an unintentional movement or an oscillation of the elevator car in the movement for introducing and releasing the elevator car into or from the receiving position as well as during the movement with the carrying device.

Furthermore, the guide rail elements can be flush with the guide rails of the elevator in a loading position of the carrying device so that the guide rail elements of the carrying device and the guide rails of the elevator form a guide for the elevator car extending into the carrying device, whereby the elevator car, in the loading position of the carrying device, is movable between the operating position and the receiving position. Thus, in this configuration the elevator car never leaves the guide or the guide rail element because it is a portion of the carrying device and thus changes the elevator shaft or the track in common with the entire carrying device.

The loading position of the carrying device denotes the position of the displaceable carrying device in which the elevator car can be moved into the carrying device. In this case, the guide rail elements are flush and aligned with the guide rails of the elevator or the elevator shaft and form a continuous transition. Thus, an extension of the guide rails into the carrying device is generated so that the elevator car can unimpededly continue its movement in the longitudinal direction of the elevator shaft into the carrying device and can thus be extracted from the elevator shaft. In an analog manner, an insertion into the elevator shaft in the opposite direction is enabled.

The guide rail elements can be configured such that the elevator car can be moved through the carrying device. This means that the guide rail elements are flush and aligned with the guide rails of the elevator on one side of the carrying device, and on the opposite side are arranged in an extension of the guide rails located there. In this manner, the elevator car can not only be displaced along the guide rails into the carrying device but also leave the carrying device along the guide rails on the opposite side.

Furthermore, the carrying device can comprise at least one fastening means for connecting the elevator car to the carrying device in the receiving position. The fastening means serves for securing the elevator car in the carrying device. Depending upon its configuration, the fastening means can in particular be provided for securing the elevator car in the carrying device and/or for releasably connecting the elevator car to the main drive responsible for moving the elevator car or to the auxiliary drive. In this case, the fastening means provides the connection between the elevator car and the main drive and/or the auxiliary drive so that the elevator car can be moved by means of the auxiliary drive into the carrying device or out of the carrying device. For example, the fastening means can be configured so that it is active in a current-free (powerless) condition and thus prevents even in an emergency or in a power outage that the elevator car leaves the carrying device. For this purpose, the fastening means can be configured according to a safety device described in further detail below and comprise locking bolts, catches or brakes.

Furthermore, the movable carrying device can be secured in the loading position by a locking means. This guarantees that the carrying device is exactly in the designated loading position and also remains exactly positioned during the reception of the elevator car when it is released or during its insertion. In this way, the elevator can precisely be introduced into the guide rails of the elevator shaft or alternatively the guide rail elements of the carrying device are flush and aligned with the guide rails of the elevator shaft.

For example, the locking means can be configured such that it is active in a current-free state and thus even in an emergency or a power outage prevents that the carrying device leaves the loading position. For this purpose, locking bolts, catches or brakes can be used, and the locking means can be configured as a safety device.

Such a safety device which, as described above, can be used as a fastening means and/or a locking means, for example, is configured such that it is active in the current-free state. For this purpose, the safety device comprises a magnetic clamp, a spring and a bolt which can engage a sleeve of a counterpart of the safety device. In a current-free state, the magnetic clamp releases the bolt adhered to the magnetic clamp, and the return spring pushes the bolt into the sleeve of the corresponding counterpart so that the bolt engages the sleeve. In this manner, a releasable connection which is active in the current-free state can be established between two components.

In order to move the carrying device for relocating the elevator car in at least one direction, the carrying device can be configured such that it is movable by means of a guiding arrangement in the at least one direction. Such a guiding arrangement comprises stationary rails, for example, which are arranged along a predetermined displacement direction. Any other suitable route can of course also be used as a guide on which the carrying device is displaced by means of a roller guide, sliding guide, magnet guide or air guide, for example. The respective guides can in addition comprise covers and wipers which avoid the entrance of foreign objects. Furthermore, an additional emergency guide can be provided which prevents that predetermined routes are left.

In particular with respect to a configuration of the guiding arrangement and the movement of the carrying device at the guiding arrangement, the carrying device can have a lightweight construction. This leads to lower gravitational forces acting upon the guiding arrangement as well as a lower moment of inertia of the carrying construction so that it can be displaced more easily.

The carrying device can furthermore comprise at least one buffer for buffering the elevator car. This at least one buffer is provided for limiting the movement range of the elevator car into the carrying device and for providing a stopper for the movement of the elevator car.

Furthermore, a relocating device for relocating an elevator car comprising at least one carrying device is provided, wherein the carrying device is movable in at least one direction not corresponding to a longitudinal direction of an elevator shaft into which the elevator car be moved in an operation. The elevator car itself is movable in the longitudinal direction of the elevator shaft from an operating position to a receiving position in the carrying device, wherein the elevator car, in the receiving position, is connected to the carrying device and movable in common with the carrying device in the at least one direction. Furthermore, the relocating device comprises a guiding arrangement, wherein the carrying device is movable in the at least one direction by means of the guiding arrangement.

The guiding arrangement can be configured as a guide according to the above description, and the particular configuration of the elevator and the relocating device for an elevator comprising a carrier means or not comprising a carrier means can be adapted correspondingly. Depending upon the configuration of the drive, the carrier means are used as auxiliary means for transferring the kinetic energy from the drive to the elevator car. In most cases, steel ropes, chains, belts or straps are used as carrier means. The carrier means can either circulate with the relocating device such as in a paternoster, or they can be decoupled from the elevator car in front of the relocating device such as in cable cars.

The relocating device can further comprise a return means. The return means can be provided, for example, in order to displace the carrying device along the guiding arrangement in an emergency or in case of a failure, for example. For this purpose, the return means can be operated manually or by an own drive, for example, so that a movement of the carrying device, for example for rescuing passengers, is possible even in the case of a failure of a drive of the carrying device. In this case, the return means has to be configured in different ways depending upon the kind of the used main drive. If the main drive is stationary in the elevator shaft, for example, it can be sufficient to provide a manually operable crank at the main drive, for example. However, if the main drive is located at the carrying device, it can be possible to deactivate it by Bowden cables and to move the carrying device by means of a redundant stationary drive, for example. This drive can be in a parking position and only be moved to the carrying device and coupled to it in order to tow the same so that it doesn't have to be permanently moved in common with the carrying device or so that it is not connected to the carrying device, for example. If necessary, a brake of the carrying device as well as a catching device also have to be deactivated.

The relocating device can comprise a main drive which is configured such that the elevator car is movable by means of the main drive of the carrying device from the operating position into the receiving position and/or from the receiving position, into the operating position.

Furthermore, the relocating device can comprise at least one catching means. The catching means serves for example for securing the carrying device against a possible crash. Furthermore, the catching means can be configured such that it can brake and stop or secure a displacement of the carrying device along the guiding arrangement. The catching means can also be configured so that in a current-free state it is active according to the above-described safety device.

Furthermore, the relocating device can comprise at least one controller for controlling the relocating device and/or the carrying device.

The relocating device can further be equipped with buffers for buffering the carrying device. For this purpose, the buffers are provided in the region of the ends of the guiding arrangement or at the carrying device itself, for example, in order to limit the displacement range of the carrying device and to provide stoppers for this purpose.

The relocating device can further comprise adjustable buffers arranged at specific positions of the guide rails of the elevator, e.g. at their ends, so that they can be activated on demand or in an emergency and prevent that the elevator car guided by the guide rails passes the corresponding position. Alternatively, the adjustable buffers can be arranged under the relocating device or the carrying device and thus prevent a downward movement of the elevator car if it should get released from the carrying construction in an uncontrolled manner. For this purpose, the adjustable buffers can be configured so that they get active in the current-free state, according to the above-described safety device, for example.

The relocating device can be arranged at an end of the respective elevator shaft, for example.

It is also possible that the relocating device is arranged at an arbitrary position of the elevator shaft. This position of the elevator shaft should allow the passage of elevator cars in this case, however. This is enabled by a corresponding configuration of the carrying device, for example, which guarantees that the elevator car can be moved through the carrying device as described above. In the same manner, it is possible to displace the carrying device and to remove it from the elevator shaft in order to prevent an interference with passing elevator cars. Of course, the guide rails have to be configured in a suitable manner for this purpose.

By means of the above-described relocating device, the respective elevator car can be extracted at the corresponding position of the elevator shaft from a first elevator shaft and introduced into a different shaft, for example. This enables a high adaptability to given demands for the entire lift system and a high flexibility. The elevator car therefore does not necessarily have to be moved to the end of the respective elevator shaft in order to be displaced at this location by the carrying device, but it can be extracted or introduced already at a position located between the ends. Of course, in an elevator shaft several relocating devices can be provided such as relocating devices at the ends of the elevator shaft and at arbitrary positions between the ends of the elevator shaft. Hereby, another substantial increase of the efficiency and flexibility can be achieved.

For this purpose, the carrying device for the relocating device is configured according to the above description. Furthermore, a method for relocating an elevator car is provided in which the elevator car is moved in a carrying device, wherein the carrying device is in a first loading position and the elevator car is moved from an operating position into a receiving position. Furthermore, the elevator car is connected to the carrying device by a connection when it is in the receiving position. The method further comprises the step of moving the carrying device in common with the elevator car in at least one direction not corresponding to a longitudinal direction of an elevator shaft in which the elevator car is movable in an operation.

The method can further comprise moving the carrying device in common with the elevator car into a second loading position, releasing the connection and moving the elevator car from the receiving position to a second operating position.

In this case, the movement of the elevator car into the receiving position and/or into the first or the second operating position can be performed by means of a main drive of the relocating device and/or an auxiliary drive.

Furthermore, the method can comprise securing the carrying device at least in the first or the second loading position by locking means and releasing the locking means for moving the carrying device.

The illustrated procedure of the method substantially relates to a movement of the elevator car into the carrying device or a transfer (extraction) of the elevator car out of the elevator shaft. An insertion or introduction of the elevator car into the elevator shaft is performed in the corresponding opposite sequence in this case.

A detailed procedure of the method is again represented in the following with alternative or additional steps for the procedure of inserting the elevator car into the elevator shaft and can of course be applied to the extraction of the elevator car in the opposite sequence.

The elevator car is initially in the receiving position of the carrying device and secured by the locking means. The carrying device is displaced into the loading position (the position is correspondingly also used for discharging) over the elevator shaft. The locking means for securing the carrying device detects the arrival at the loading position and secures the carrying device. It is thus prevented from leaving the loading position without authorization. Subsequently, the locking means is released, the adjustable buffers, if applicable, are opened in the region of the guide rails of the elevator shaft, and the elevator car is moved from the receiving position in the carrying device into the operating position. The elevator car is now connected to the guide rails of the elevator or inserted into the elevator shaft and can begin its movement along the guide rails. After completion of the insertion and removal of the elevator car from the carrying device, the locking means of the carrying device can be released, and the adjustable buffers for limiting the guide rails of the elevator shaft can be activated. The carrying device can now be used again and displaced along the guiding arrangement.

Furthermore, the procedure of the method can be configured such that in the method several carrying devices (1*b*) are independently movable within a relocating device (1*a*).

Further advantages and configurations of the invention will occur with respect to the specification and the accompanying drawings. It should be understood that the above-mentioned features and the features to be explained below can be used not only in the respective indicated combination but also in other combinations or individually without leaving the scope of the present invention.

The invention is schematically illustrated in the drawings with respect to embodiments and will be described below in detail with respect to the drawings.

DETAILED DESCRIPTION OF THE INVENTION

Figure 1A:
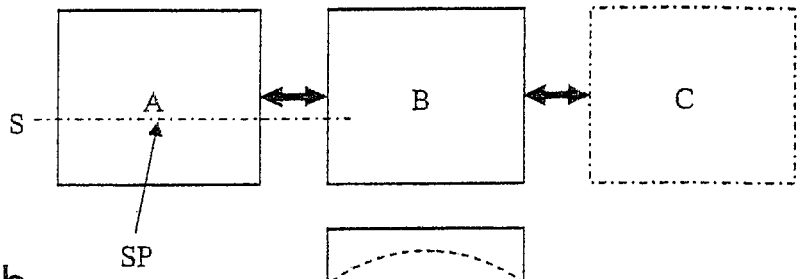
FIGS. 1*a*, 1*b* and 1*c* show possible displacement paths for elevator cars between adjacent elevator shafts in a schematic illustration.

The Figures are described coherently and comprehensively, wherein equal reference characters denote equal components.

FIG. 1*a* shows potential displacement paths for elevator cars between adjacent elevator shafts in a plan view and a schematic illustration. Here, FIG. 1*a* shows three elevator shafts A, B, C arranged in a row. Furthermore, a center of mass SP of the elevator car and the associated center of mass axis S which simultaneously represents a track of the elevator are illustrated. An elevator car can be extracted from an elevator shaft A by means of a relocating device and inserted into an elevator shaft B or C, for example. Of course, any other permutation between the three illustrated elevator shafts A, B, C is also possible. Furthermore, the number of three elevator shafts A, B, C is only exemplary and can thus be varied arbitrarily.

Figure 1B:
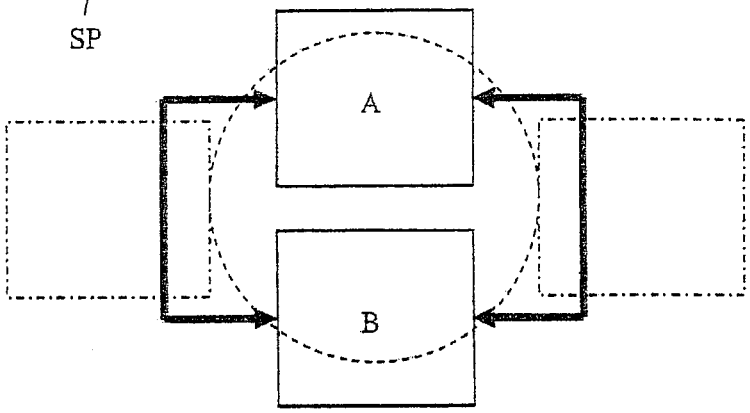

FIG. 1*b* shows the exchange of elevator cars between two adjacent elevator shafts A and B by means of a rotational motion. In this case, an elevator car is extracted from each a first elevator shaft A and a second elevator shaft B, respectively, and moved to the respective other elevator shaft A or B on different paths. This can be achieved by suitable designs of the guiding arrangement for the carrying devices, for example. According to the schematically illustrated embodiment, the guiding arrangement has a circular guide for carrying devices or a disc-shaped rotatable plate at which a number of carrying devices is arranged and which can move the carrying devices to the corresponding positions. Of course, also in this case, the number of elevator shafts is not limited, and an arbitrary number of elevator shafts can rather be circularly arranged, and the elevator cars can rather be exchanged at a rotating guide or with the aid of the rotatable plate between the elevator shafts.

Figure 1C:
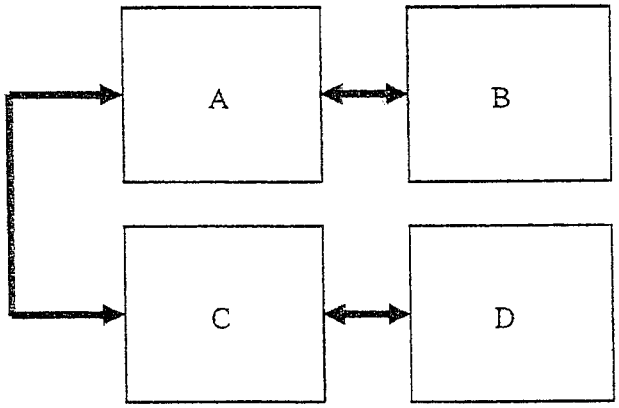

According to FIG. 1*c*, the elevator shafts A, B, C, D can be provided in rows arranged in parallel to each other. Of course, each row can be configured according to FIG. 1*a* and include an arbitrary number of elevator shafts, wherein a displacement of elevator cars within the illustrated rows of the elevator shafts A, B or C, D is performed according to the illustration in FIG. 1*a*. Furthermore, the illustrated two rows are additionally connected by an interchangeability between the rows so that elevator cars can also be exchanged between a first row A, B and a second row C, D (comparable to the relocating device in FIG. 1*b*).

Figure 2:
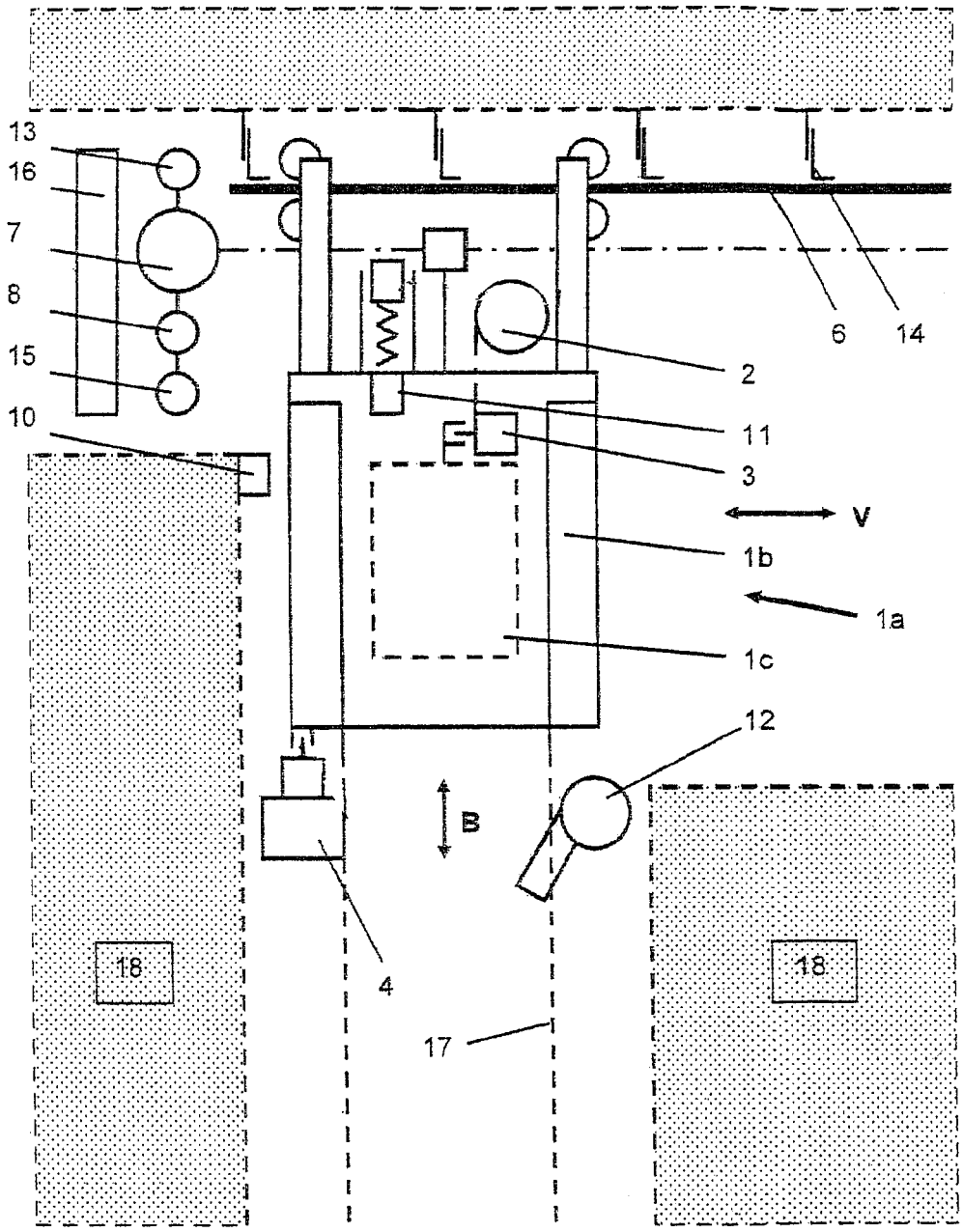
FIG. 2 shows a side view of a relocating device in a schematic illustration.

FIG. 2 shows a relocating device 1*a* comprising a guiding arrangement 6 and a carrying device 1*b* in a schematic side view of an elevator without carrier means. In this case, the carrying device 1*b* is displaceable in the horizontal direction along the guiding arrangement 6 (in the direction of the double arrow V). Furthermore, an elevator shaft is illustrated which is limited by the shaft walls 18 and which enables guide rails 17 for a vertical movement of an elevator car 1*c* along the guide rails 17 in the direction of the double arrow B. For relocating the elevator car 1*c* by means of the relocating device 1*a*, the carrying device 1*b* is translated into a loading position (as illustrated in FIG. 2). In this case, the carrying device 1*b* is arranged over the elevator shaft so that guide rail elements of the carrying device 1*b* abut the guide rails 17 of the elevator shaft and are aligned with them and a continuous guide of the elevator car 1*c* is provided. In the loading position, the carrying device 1*b* is locked or secured in the corresponding position by a locking means 4. The elevator car 1*c* is moved from an operating position in which the elevator car 1*c* is located in the area of the guide rails 17 of the elevator shaft along the guide rails 17 and the subsequent guide rail elements of the carrying device 1*b* to the carrying device 1*b*. For this purpose, an auxiliary drive 2 is used which latches to the elevator car 1*c* by a fastening means 3 and pulls the elevator car 1*c* into the carrying device 1*b* until the elevator car 1*c* is in a so-called receiving position. Here, the control of the auxiliary drive 2 is performed by a controller 16. The controller 16 further controls the entire relocating device 1*a* or the carrying device 1*b*.

In order to avoid that the elevator car 1*c* collides with the carrying device 1*b*, a buffer 11 is provided at the carrying device 1*b* as a stopper for the elevator car 1*c* preventing a further movement of the elevator car 1*c* in the vertical moving direction B. As soon as the elevator car 1*c* is in the receiving position in the carrying device, the fastening means 4 can be released. The carrying device 1*b* can then be displaced along the guiding arrangement 6.

In the illustrated embodiment, the guiding arrangement 6 comprises rails which are mounted at the surrounding walls by means of a shaft equipment 14, and the carrying device 1*b* is guided along the rails by means of rollers or wheels. Hereby, the carrying device 1*b* can be displaced horizontally in the direction of the double arrow V. For limiting the horizontal displacement of the carrying device 1*b*, a buffer 10 is provided at the shaft wall 18 at the end of the guiding arrangement 6. Furthermore, the relocating device 1*a* comprises an adjustable buffer 12 which in a normal operation of the elevator prevents that the elevator car 1*c* leaves the guide rails 17 of the elevator shaft if the carrying device 1*b* is not in the loading position above the elevator shaft and prepared to receive the elevator car 1*c*.

Apart from the controller 16 for controlling the carrying arrangement 1*b*, the relocating device 1*a* comprises a return means 13 for being able to displace the carrying device 1*b* even in case of an emergency or a technical defect or a malfunction and to be able to free possible trapped passengers. Furthermore, a main drive 7 for driving the carrying device 1*b* is provided. The main drive 7 furthermore comprises a brake 8 and a device 15 for monitoring the position and the velocity of the carrying device 1*b*. The brake 8 can brake and hold the main drive, for example, and it can be configured so that it is active or effective in particular in a powerless state.

According to the schematic illustration, the relocating device is configured so that for its operation, apart from recesses, no shaft cross-sections larger than the respective elevator itself are required.

The invention claimed is:

1. Relocating device for relocating an elevator car from one elevator shaft to another elevator shaft, comprising:

a carrying device;

the carrying device is movable in at least one direction not corresponding to a longitudinal direction of the one or the another elevator shaft in which the elevator car is movable in operation, and the elevator car is movable in the longitudinal direction of the one elevator shaft from an operating position to a receiving position in the carrying device, wherein the elevator car, in the receiving position, is connected to the carrying device and movable in the at least one direction commonly with the carrying device;

a guiding arrangement, wherein the carrying device is movable in the at least one direction by means of the guiding arrangement;

the carrying device comprises a main drive and an auxiliary drive;

the elevator car is movable by means of the auxiliary drive from the operating position in the one elevator shaft to the receiving position and from the receiving position to the operating position in the another elevator shaft;

the elevator car is connected to the auxiliary drive at the receiving position in the one elevator shaft and disconnected from the auxiliary drive at the operating position at the another elevator shaft;

the elevator car is disconnected from the auxiliary drive during regular operation of the elevator during which the elevator car is moved upwards and downwards in the another elevator shaft;

the carrying device is movable by means of the main drive in the at least one direction not corresponding to a longitudinal direction of the one or the another elevator shaft in which the elevator car is moved in regular operation;

wherein neither the main drive nor the auxiliary drive is responsible for the regular operation of the elevator during which the elevator car is moved upwards and downwards in the elevator shaft; and a return means configured to displace the carrying device along the guiding arrangement in an emergency in case of a failure of the main drive, the return means comprising another drive.

2. Relocating device according to claim 1, wherein the relocating device comprises at least one catching means.

3. Relocating device according to claim 1, and further comprising a controller for controlling the relocating device or the carrying device.

4. Relocating device according to claim 1, wherein the relocating device comprises buffers for buffering the carrying device.

5. Relocating device according to claim 1, wherein the relocating device comprises buffers that are activated on demand.

6. Relocating device according to claim 1, wherein the relocating device is arranged at least at one end of the elevator shaft.

7. Relocating device according to claim 1, wherein the relocating device is arranged at a position of the elevator shaft.

8. Relocating device according to claim 1, wherein the another drive is operated manually.

9. Relocating device according to claim 1, wherein the another drive is stationary and configured to be coupled to the main drive.

10. Relocating device according to claim 1, wherein the another drive is movable with the carrying device.

11. Method for relocating an elevator car from one elevator shaft to another elevator shaft, comprising the following steps:

moving the elevator car from one operating position in the one elevator shaft into a receiving position in a carrying device with an auxiliary drive connected to the elevator car;

moving by a main drive the elevator car in at least one direction not corresponding to a longitudinal direction of the one or the another elevator shaft;

moving the elevator car from the receiving position to another operating position in the another elevator shaft with the auxiliary drive;

disconnecting the auxiliary drive from the elevator car in the another operating position in the another elevator shaft;

wherein neither the main drive nor the auxiliary drive is responsible for the regular operation of the elevator during which the elevator car is moved upwards and downwards in the elevator shaft; and displacing the carrying device along the guiding arrangement in an emergency in case of a failure of the main drive by means of another drive.

12. Method according to claim 11, further comprising the following steps:

moving the carrying device commonly with the elevator car to a second loading position;

releasing the connection; and moving the elevator car from the receiving position into a second operating position.

13. Method according to claim 11, further comprising the following steps:

securing the carrying device at least in the first or the second loading positions by locking means; and releasing the locking means for moving the carrying device.

14. Method according to claim 11, wherein a plurality of carrying devices are independently movable within a relocating device.

15. Method according to claim 11, and further comprising the step of manually operating the another drive.

16. Method according to claim 11, and further comprising the step of coupling the another drive to the main drive.

17. Method according to claim 11, and further comprising the step of moving the another drive with the carrying device.

18. Relocating device for relocating an elevator car from one elevator shaft to another elevator shaft, comprising:

a carrying device;

the carrying device is movable in at least one direction not corresponding to a longitudinal direction of the one or the another elevator shaft in which the elevator car is movable in operation, and the elevator car is movable in the longitudinal direction of the one elevator shaft from an operating position to a receiving position in the carrying device, wherein the elevator car, in the receiving position, is connected to the carrying device and movable in the at least one direction commonly with the carrying device;

a guiding arrangement, wherein the carrying device is movable in the at least one direction by means of the guiding arrangement;

the carrying device comprises a main drive and an auxiliary drive;

the elevator car is movable by means of the auxiliary drive from the operating position in the one elevator shaft to the receiving position and from the receiving position to the operating position in the another elevator shaft;

the elevator car is connected to the auxiliary drive at the receiving position in the one elevator shaft and disconnected from the auxiliary drive at the operating position at the another elevator shaft;

the elevator car is disconnected from the auxiliary drive during regular operation of the elevator during which the elevator car is moved upwards and downwards in the another elevator shaft;

the carrying device is movable by means of the main drive in the at least one direction not corresponding to a longitudinal direction of the one or the another elevator shaft in which the elevator car is moved in regular operation, wherein neither the main drive nor the auxiliary drive is responsible for the regular operation of the elevator during which the elevator car is moved upwards and downwards in the elevator shaft; and a return means configured to displace the carrying device along the guiding arrangement in an emergency in case of a failure of the main drive, the return means comprising a crank configured to operate the main drive manually.

19. Method for relocating an elevator car from one elevator shaft to another elevator shaft, comprising the following steps:

moving the elevator car from one operating position in the one elevator shaft into a receiving position in a carrying device with an auxiliary drive connected to the elevator car;

moving by a main drive the elevator car in at least one direction not corresponding to a longitudinal direction of the one or the another elevator shaft;

moving the elevator car from the receiving position to another operating position in the another elevator shaft with the auxiliary drive;

disconnecting the auxiliary drive from the elevator car in the another operating position in the another elevator shaft;

wherein neither the main drive nor the auxiliary drive is responsible for the regular operation of the elevator during which the elevator car is moved upwards and downwards in the elevator shaft; and displacing the carrying device along the guiding arrangement in an emergency in case of a failure of the main drive by manually operating the main drive with a crank.

* * * * *